US005810180A

United States Patent [19]

Chan

[11] Patent Number: 5,810,180

[45] Date of Patent: Sep. 22, 1998

[54] FIXING DEVICE FOR LAUNDRY RODS

[76] Inventor: Yung-Nong Chan, 64, Lane 46, Shy-Wei Rd., Tou-Nan, Yun-Lin Hsien, Taiwan

[21] Appl. No.: 880,636

[22] Filed: Jun. 23, 1997

[30] Foreign Application Priority Data

May 26, 1997 [TW] Taiwan ..... 86208667

[51] Int. Cl.[6] ..... A47F 5/08

[52] U.S. Cl. ..... 211/117; 211/123; 248/251

[58] Field of Search ..... 248/251, 252, 248/256, 257, 258, 261, 327, 333, 335, 337, 254, 229.1, 214, 215, 340, 228.3, 229.27, 326, 317, 228.7; 211/119.17, 113, 122, 123, 117, 118, 208

[56] References Cited

U.S. PATENT DOCUMENTS

| | | | |
|---|---|---|---|
| 868,829 | 10/1907 | Adenhart | 160/180 |
| 1,104,180 | 7/1914 | Forlong | 211/123 |
| 1,242,345 | 10/1917 | Grimm | 248/258 |
| 1,250,828 | 12/1917 | Erickson | 36/40 |
| 2,169,053 | 8/1939 | Lowe | 248/263 |
| 2,521,062 | 9/1950 | Hott | 248/252 |
| 2,867,918 | 1/1959 | Miller | 434/150 |
| 2,922,567 | 1/1960 | McDermott | 229/117.21 |
| 2,980,383 | 4/1961 | Anderson et al. | 248/317 |
| 3,921,814 | 11/1975 | Solomon | 211/162 |
| 4,037,728 | 7/1977 | Cameron | 211/124 |
| 4,079,840 | 3/1978 | Usner | 211/124 |
| 4,426,057 | 1/1984 | Nudo | 248/235 |
| 4,480,809 | 11/1984 | Healey | 248/185 |
| 5,076,446 | 12/1991 | Simmerman et al. | 211/113 |
| 5,314,155 | 5/1994 | Behrendt et al. | 248/301 |
| 5,480,116 | 1/1996 | Callas | 248/228.4 |

*Primary Examiner*—Leslie A. Braun
*Assistant Examiner*—Tan Le
*Attorney, Agent, or Firm*—Larson & Taylor

[57] ABSTRACT

A fixing device includes two horizontally spaced supporting member for supporting laundry rods thereon. An L-shape fixing member is attached to each supporting member and includes a vertical tube section having a number of vertically spaced holes defined in a periphery thereof and a horizontal section. A pair of clamping plates are respectively, securely mounted to two sides of each of two ends of a downwardly extending flange wall of a house. Each clamping plate includes an upper screw hole defined therein, and a bolt is extended through at least one of the upper screw holes to frictionally engage with at least one of two sides of the flange wall. Each clamping plate further includes a lower hole defined therein through which the horizontal section of the fixing member extends.

3 Claims, 4 Drawing Sheets

FIXING DEVICE FOR LAUNDRY RODS

BACKGROUND OF THE INVENTION

1. Field of the Invention

The present invention relates to an improved fixing device for laundry rods.

2. Description of the Related Art

A typical fixing device for laundry rods is shown in FIG. 5 of the drawings. Such a fixing device includes a pair of main bodies 50 (only one of them is shown) having a number of positioning holes 51 through which laundry rods may extend. Two vertical posts 52 extending upwardly from the main body 50 and each of which has a bolt 53 fixed thereon. An L-shape bracket 60 is adjustably mounted to each post 52. Each bracket 60 includes a vertical section having an elongated slot 61 defined therein and a horizontal section having a hole 62 defined therein. The vertical section of each bracket 60 is secured to the associated post 52 by means of releasably engaging an adjusting nut 54 with the associated bolt 53 which is extended through the slot 61 and thus allows adjustment of the bracket 60 in the vertical direction. The bracket 60 is fixed to a ceiling of a house by means of a bolt 63 extending through the hole 62 and through another hole in the ceiling. However, the ceiling must be drilled so as to form the holes for engagement with the bolts 63 which is troublesome and causes damage to the ceiling. The present invention is intended to provide an improved fixing device which mitigates and/or obviates the above problems.

SUMMARY OF THE INVENTION

A fixing device for laundry rods in accordance with the present invention includes two horizontally spaced supporting means for supporting laundry rods thereon. A substantially L-shape fixing member is adjustably attached to each supporting means and includes a vertical tube section having a plurality of vertically spaced holes defined in a periphery thereof and a horizontal section.

Each supporting means includes an engaging member extending upwardly therefrom. The engaging tube includes a hole, and an elastic engaging piece is mounted inside the engaging member and includes a protrusion releasably extending through the hole of the engaging member and through one of the vertically spaced holes, thereby allowing adjustment of the vertical tube section of the fixing member relative to the engaging member in the vertical direction.

A pair of clamping plates are respectively, securely mounted to two sides of each of two ends of a downwardly extending flange wall of a house. Each clamping plate includes an upper screw hole defined therein, and a bolt is extended through at least one of the upper screw holes to frictionally engage with at least one of two sides of the flange wall. Each clamping plate further includes a lower hole defined therein through which the horizontal section of the fixing member extends. In addition, a bolt is extended through a screw hole defined in a periphery defining the lower hole to frictionally engage with the horizontal section of the fixing member to prevent movement of the fixing member.

Other objects, advantages, and novel features of the invention will become more apparent from the following detailed description when taken in conjunction with the accompanying drawings.

DESCRIPTION OF THE PREFERRED EMBODIMENT

Figure 1:
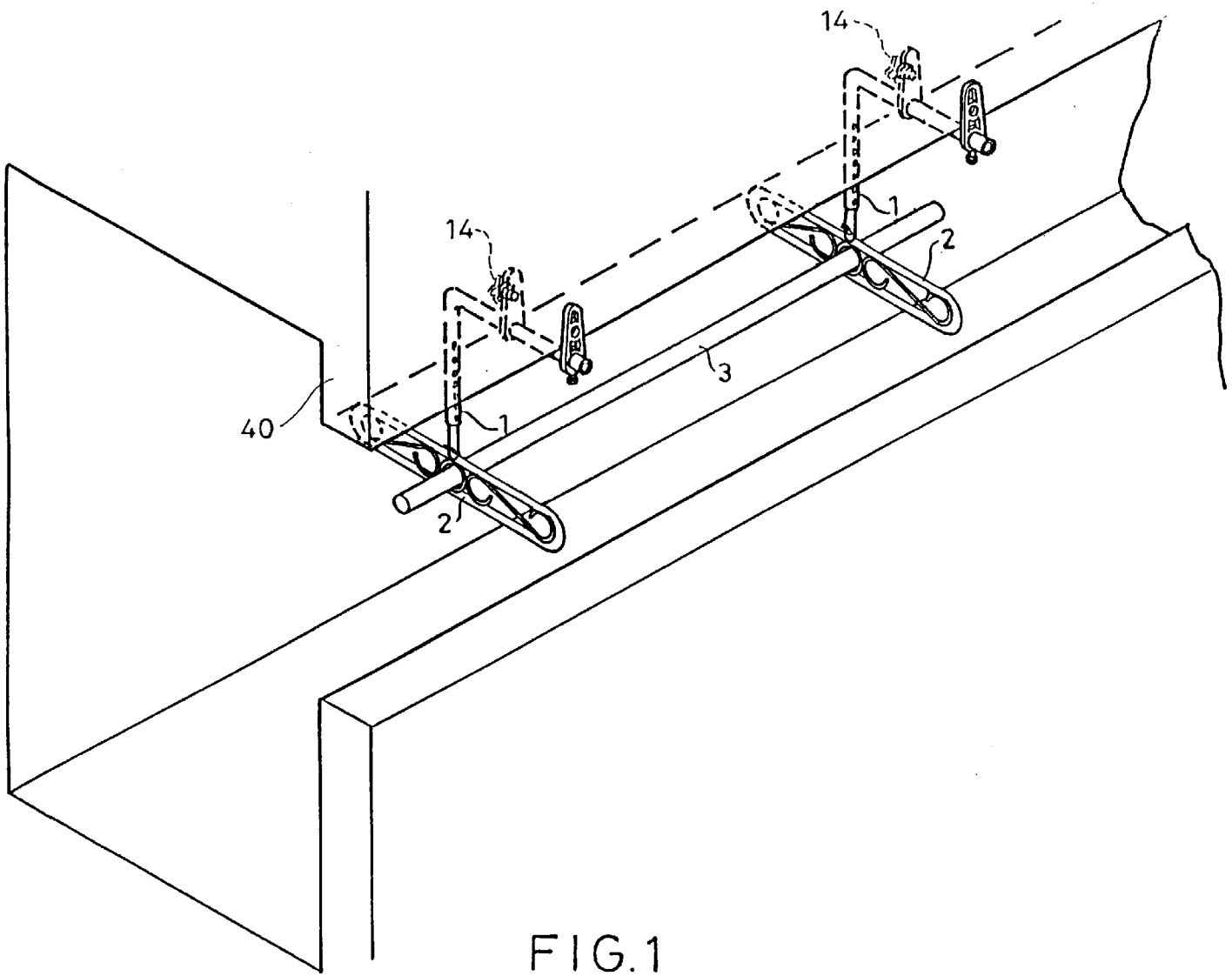
FIG. 1 is a perspective view of a fixing device for laundry rods in accordance with the present invention mounted to a downwardly extending flange wall of a house.
Figure 2:
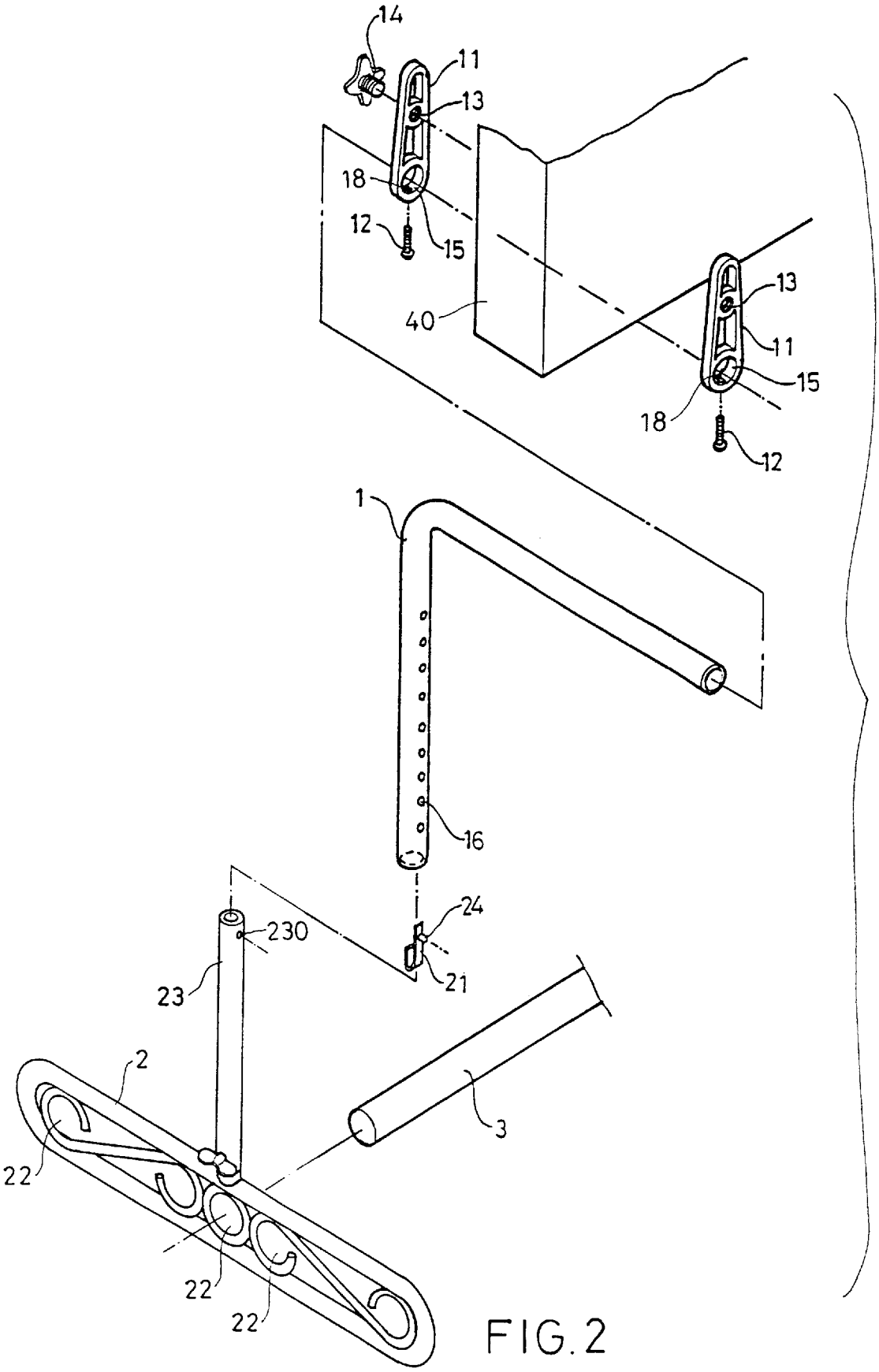
FIG. 2 is an exploded perspective view of a half portion of the fixing device in accordance with the present invention.

Referring to FIGS. 1 to 4 and initially to FIG. 1 and 2, a fixing device for laundry rods in accordance with the present invention generally includes two horizontally spaced supporting means 2 each of which includes a number of holes 22 through which laundry rods 3 extend. A substantially L-shape fixing member 1 is adjustably attached to each supporting means 2 and includes a vertical tube section having a plurality of vertically spaced holes 16 defined in a periphery thereof and a horizontal section.

Figure 4:
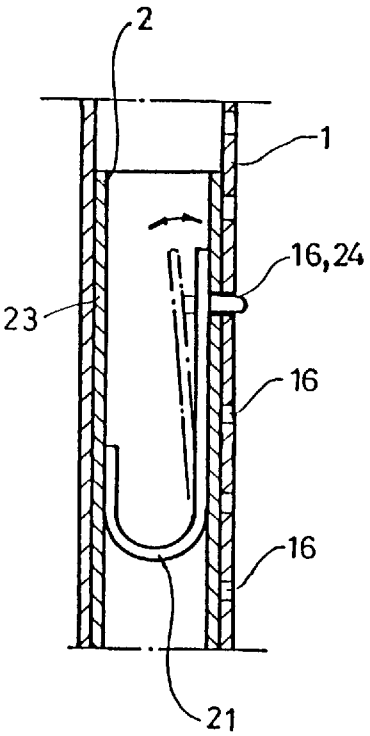
FIG. 4 is an enlarged view of a circle in FIG. 3.

Each supporting means 2 includes an engaging member 23 extending upwardly therefrom. The engaging member 23 includes a hole 230 (FIG. 2) defined in an upper end thereof, and an elastic engaging piece 21 is mounted inside the engaging member 23 and includes a protrusion 24 releasably extending through the hole 230 and through one of the vertically spaced holes 16, thereby allowing adjustment of the vertical tube section of the fixing member 1 relative to the engaging member 23 in the vertical direction, as shown in FIG. 4.

Figure 3:
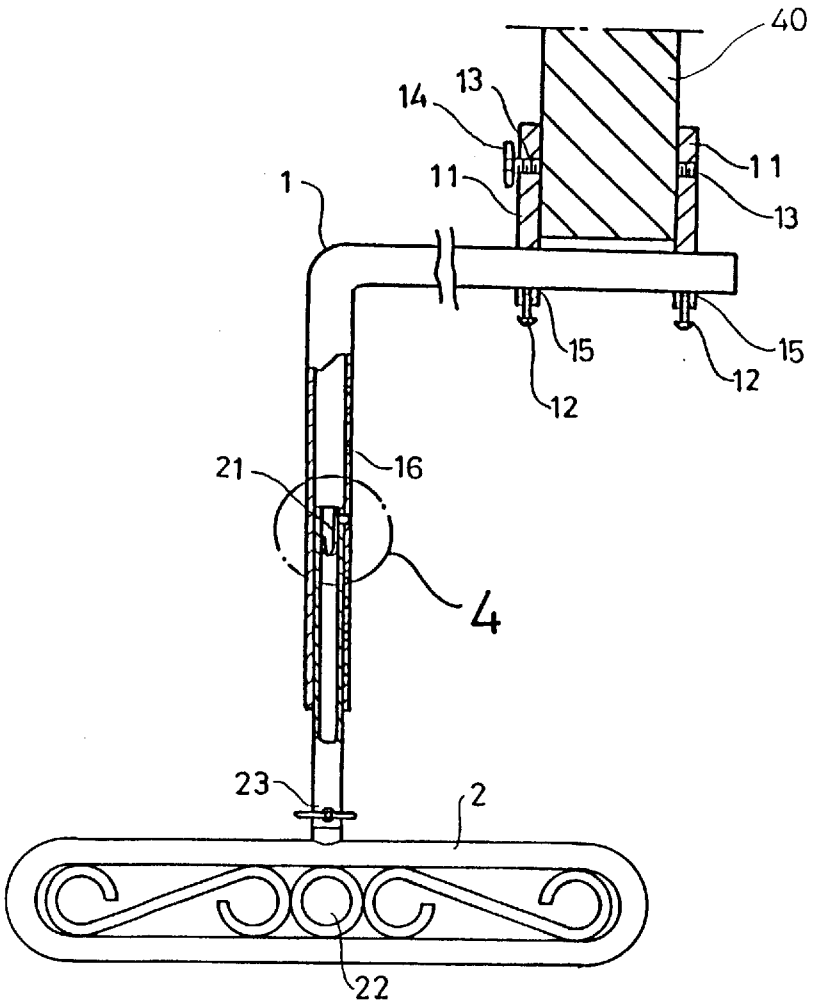
FIG. 3 is a side elevational view,partially sectioned, of the fixing device in accordance with the present invention.
Figure 5:
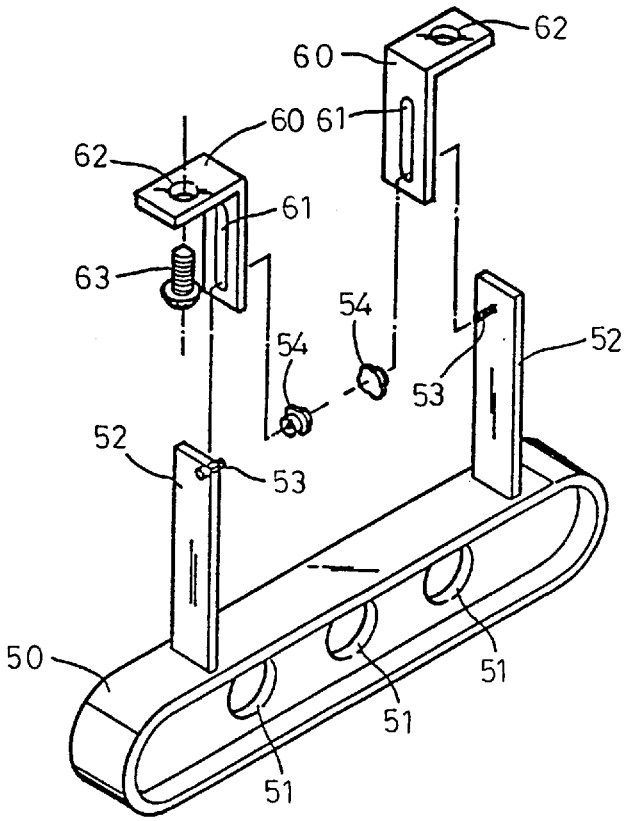
FIG. 5 PRIOR ART
FIG. 5 is an exploded perspective view illustrating a fixing device for laundry rods according to prior art.

Referring to FIGS. 1 to 3, a pair of clamping plates 11 are respectively, securely mounted to two sides of each of two ends of a downwardly extending flange wall 40 (FIG. 1) of a house. Each clamping plate 11 includes an upper screw hole 13 defined therein, and a bolt 14 extended through each upper screw hole 13 to frictionally engage with at least one of two sides of the flange wall 40, as shown in FIG. 3. Nevertheless, in a modified embodiment of the invention, a bolt 14 is extended through one of the upper screw holes 13 to achieve the frictional engagement. Each clamping plate 11 further includes a lower hole 15 defined therein through which the horizontal section of the fixing member 1 extends, best shown in FIG. 3. In addition, a bolt 12 is extended through a screw hole 18 (FIG. 2) defined in a periphery defining the lower hole 15 to frictionally engage with the horizontal section of the fixing member 1 to prevent movement of the fixing member 1.

According to the above description, it is appreciated that the fixing device of the present invention can be mounted to the flange wall of the house without damaging the structure thereof.

Although the invention has been explained in relation to its preferred embodiment, it is to be understood that many other possible modifications and variations can be made without departing from the spirit and scope of the invention as hereinafter claimed.

What is claimed is:

1. A fixing device for laundry rods, comprising:

two horizontally spaced supporting means adapted to support laundry rods thereon, an L-shape fixing member attached to each said supporting means and including a vertical tube section having a plurality of vertically spaced holes defined in a periphery thereof and a horizontal section, a pair of clamping plates secured to each said horizontal section adapted to be respectively, securely mounted to two sides of each of two ends of a downwardly extending flange wall of a house, each said clamping plate including an upper screw hole defined therein, a bolt being extended through at least one the upper screw holes to frictionally engage with at least one of two sides of the flange wall, each said clamping plate further including a lower hole defined therein through which the horizontal section of the fixing member extends.

2. The fixing device according to claim 1, wherein each said supporting means includes an engaging member extending upwardly therefrom, the engaging member includes a hole, and an elastic engaging piece is mounted inside the engaging member and includes a protrusion releasably extending through the hole of the engaging member and through one of the vertically spaced holes of the vertical tube section, thereby allowing adjustment of the vertical tube section of the fixing member relative to the engaging member in the vertical direction.

3. The fixing device according to claim 1, wherein a periphery defining the lower hole of each said fixing member includes a second screw hole defined therein, and a further bolt is extended through the second screw hole to frictionally engage with the horizontal section of the fixing member.

* * * * *